US005516166A

United States Patent [19]

Frolov et al.

[11] Patent Number: 5,516,166

[45] Date of Patent: May 14, 1996

[54] ELECTROMAGNETIC LOCK

[75] Inventors: George A. Frolov, Farmington; Peter S. Conklin, Simsbury, both of Conn.

[73] Assignee: Harrow Products, Inc., Grand Rapids, Mich.

[21] Appl. No.: 442,180

[22] Filed: May 16, 1995

Related U.S. Application Data

[63] Continuation of Ser. No. 980,774, Nov. 24, 1992, abandoned.

[51] Int. Cl.[6] ..... E05C 17/56

[52] U.S. Cl. ..... 292/251.5; 335/250

[58] Field of Search ..... 292/251.5, 341.16; 335/282, 250

[56] References Cited

U.S. PATENT DOCUMENTS

| | | | |
|---|---|---|---|
| 1,996,606 | 4/1935 | Ayers | 335/250 X |
| 3,221,191 | 11/1965 | Cuches et al. | 335/250 X |
| 4,390,857 | 6/1983 | Kubach | 335/282 |
| 4,840,411 | 6/1989 | Sowersby | 292/251.5 |
| 5,016,929 | 5/1991 | Frolov | 292/251.5 |
| 5,184,854 | 2/1993 | Chen | 292/251.5 |
| 5,376,910 | 12/1994 | Geringer et al. | 292/251.5 X |

FOREIGN PATENT DOCUMENTS

| | | | |
|---|---|---|---|
| 2843593 | 4/1980 | Germany | 335/250 |

*Primary Examiner*—Rodney M. Lindsey
*Attorney, Agent, or Firm*—Chilton, Alix & Van Kirk

[57] ABSTRACT

An electromagnetic lock employs a pre-wound bobbin which is forced onto the E-shaped lamination stack of a magnetic core. The housing is configured in two longitudinal sections which are relatively pivotal to provide access for circuitry within the housing for both an outswinging and an inswinging door lock installation. The electromagnet also employs a circuit to sense the power supply to the electromagnet and to automatically select the operating voltage of the electrical coil.

17 Claims, 5 Drawing Sheets

ELECTROMAGNETIC LOCK

This is a continuation of application Ser. No. 07/980,774 filed on Nov. 24, 1992 now abandoned.

BACKGROUND OF THE INVENTION

This invention relates generally to electromagnetic locks which are positioned for securing a doorway or entranceway. More particularly, the present invention relates to electromagnetic locks which are mounted at the top of the doorway and are energizable for electromagnetic bonding with an armature mounted to the door.

Electromagnetic locks have proved to be highly reliable for securing doorways, entranceways and the like. The recent trends in applications for electromagnetic locks have tended to require the use of increased electronics as a part of a more sophisticated overall security system. As the capabilities of electromagnetic locks have increased, it has become advantageous to provide additional on board electronic capability for each electromagnetic lock unit.

Conventional electromagnetic locks to which the invention relates, employ a metal core comprising a stack of generally E-shaped laminations. A coil is wound around the middle leg of the lamination stack. The lamination stack and the coil are mounted in a housing and the coil is potted to the core. The potting of the coil requires a separate manufacturing operation and ordinarily precludes an efficient and cost effective procedure for repairing the electromagnet by individually replacing a defective or malfunctioning coil or core assembly.

A common provision for mounting electronics within the electromagnet housing is to provide a compartment adjacent to the end of the electromagnet housing wherein access is provided from the face of the electromagnet unit. However, the available space provided by an end compartment is conventionally quite limited even though access to the compartment is readily obtained for both inswinging and outswinging door installations. A number of possible solutions for increasing the lock unit space capacity are subject to significant installation and operational constraints. For example, increasing the capacity of the compartment by enlarging the housing so as to extend downwardly a greater distance decreases the door clearance. Likewise, modifying the overall housing to lengthen the housing to expand the capacity of the compartment disproportionately lengthens the housing, detracts from the housing aesthetics, and undesirably increases the asymmetry associated with the conventional electromagnetic lock design. A long housing may also interfere with the door closer which is usually located in the vicinity of the housing.

Naturally, ready access to the electronics after installation is a desirable feature. Some conventional lock devices have incorporated electronic compartments which are located at the back of the electromagnetic lock unit. Such designs have greatly increased the capacity for mounting on board electronics. However, such designs are applicable only for outswinging doors. For inswinging door applications, the rear electronic compartment essentially does not afford any access without dismounting the lock unit.

Electromagnetic locks, including electromagnetic shear locks and electromechanical locks, bolts and electric strikes conventionally operate on either 12 volts DC or 24 volts DC power. It is common for a given electromagnetic lock to be capable of operating at either 12 VDC or 24 VDC and to be adapted so that at the time of installation, the lock may be adjusted for the proper operating voltage. Such operating voltage setting is frequently conventionally implemented by (a) a coil designed for one pre-established voltage; (b) two separate coils with four wires which are connected at the time of installation to accommodate the supply voltage; or (c) a manual selection switch which is set at the time of installation.

SUMMARY OF THE INVENTION

Briefly stated, the invention in a preferred form is an electromagnetic lock which employs a magnetic core assembly comprising a stack of laminations having a generally E-shape which includes first and second legs and a middle leg disposed between the first and second legs. A bobbin includes a face plate and defines a slot which is dimensioned to closely slip onto the middle leg. The face plate is positioned and dimensioned to extend in a generally close fitting relationship with the legs to form a pair of parallel bands. The bands traverse between the first and middle leg of the stack and between the second and middle leg of the stack. The face plate is transversely spaced from the frontal edges to form a close fitting quasi-continuous electromagnet/face plate mechanical fit which is aesthetically pleasing and does not require additional potting or epoxy to complete the assembly.

An electrical coil is pre-wound around the bobbin. The legs of the stack extend transversely and terminate in frontal edges. The bobbin, including the face plate, preferably has a plastic material composition. The bobbin also preferably includes a rear plate which is substantially equidistantly spaced from the face plate. The core assembly and bobbin are mounted to a housing. The housing has a substantially retangular frontal opening which frames exposed edge portions of the core legs and adjacent portions of the face plate.

The electromagnetic lock housing may additionally include a first section and a mating second section. Depending on the nature of the installation, one of the sections functions as the mounting base and is adapted for mounting the electromagnetic unit in a generally fixed position relative to the door frame. The sections are pivotally connected and are cooperatively moveable between a closed position and pivoted open position. The electromagnet is mounted in a fixed position to the second section. The sections cooperate to form a box-like housing for the electromagnet in the first position and one of the sections pivots to provide access to the interior of the housing in the second position. A pivot pin connects the sections proximate end positions thereof. The first section preferably comprises an elongated U-shaped channel member. The second section is partially received by the member in the first position. Fasteners may be employed for securing the sections in the first closed position.

The coil for the electromagnet may be comprised of a first coil and a separate second coil which are each energizable to produce the magnetic field. The first and second coils may be identical. A sensor circuit is employed for sensing the supply voltage to the electromagnetic unit and comparing the supply voltage to a reference voltage. The coils are selectively connectable in either series or in parallel in response to the comparison. A relay is responsive to the comparison output for activating either the series or the parallel connection. If the supply voltage is in a first pre-established range, the coils are automatically connected in series. If the supply voltage is in a second pre-established range, the coils are automatically connected in parallel. In one form of the invention, when the voltage is sensed to be less than 16 volts, the coils are connected in parallel for 12 volt operation, and when the voltage is sensed to be greater than or equal to approximately 16 volts, the coils are connected in series for 24 volt operation. The circuit also provides a default mode for reconnecting the coils in series if power to the relay ceases.

An object of the invention is to provide a new and improved electromagnetic lock which is less expensive to manufacture and easier to repair.

Another object of the invention is to provide a new and improved electromagnetic lock which provides a high capacity for mounting on board electronics and provides post-installation access to the electronics for both inswinging and outswinging door installations.

A further object of the invention is to provide a new and improved electromagnetic lock which incorporates circuitry having means for automatically setting the electromagnet for operation at either 12 volts or 24 volts direct current.

Other objects and advantages of the invention will become apparent from the drawings and the specification.

DETAILED DESCRIPTION OF THE PREFERRED EMBODIMENTS

Figure 7:
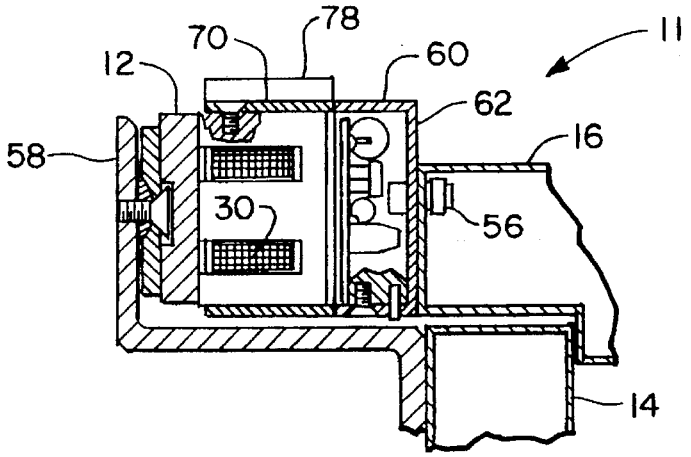
FIG. 7 is a side sectional view of the electromagnetic lock and structure of FIG. 5 taken along the line 7—7 thereof.
Figure 8:
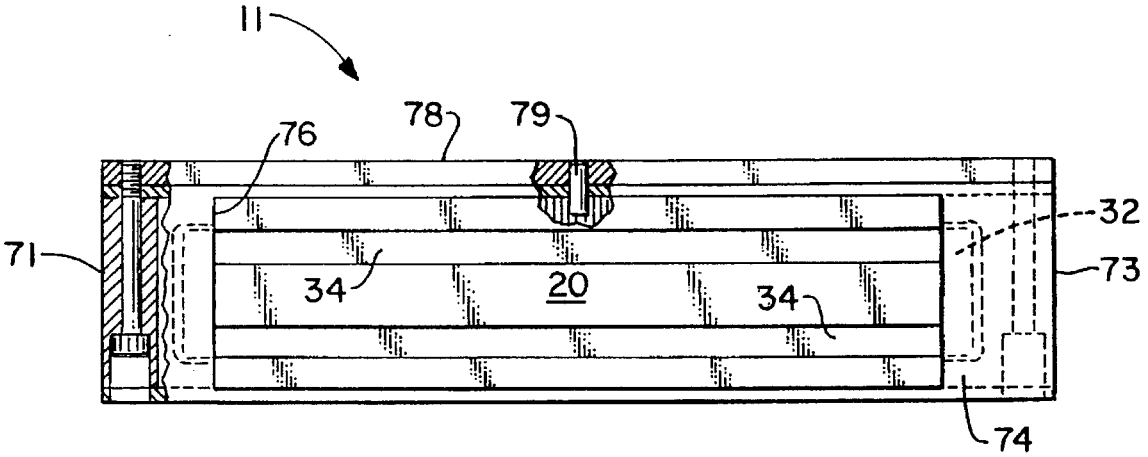
FIG. 8 is a frontal view, partly broken away, partly in section and partly in phantom, of the electromagnetic lock of FIG. 5.

With reference to the drawings wherein like numerals represent like parts throughout the figures, an electromagnetic lock in accordance with the present invention is designated generally by the numeral 10 in FIGS. 1 through 4. Electromagnetic lock 10 is adapted for mounting to the top of a door frame. Upon electrical energization of the lock, the lock bonds with an armature 12 (FIGS. 7 and 11) mounted to the door for locking the door.

The electromagnetic lock 10 includes a magnetic core 20 comprising stack of generally E-shaped laminations 22 which are welded or glued together to form a rigid assembly. Thus, the core 20 is constructed to provide independent structural integrity without any plastic encapsulating. The core includes a cross-piece 23 and a perpendicularly projecting middle leg 24 which is generally equidistantly disposed between perpendicularly projecting outer legs 26 and 28. Each of the stack legs terminate in strip-like parallel rectangular edges 25, 27 and 29, respectively. The edges 25, 27 and 29 are also preferably co-planar.

A coil 30 is pre-wound around a plastic bobbin 32 which is then mounted on the core. The bobbin 32 includes a frontal face plate 34 and a rear plate 36. The plates 34, 36 are preferably substantially identical and function to transversely retain the coil. The bobbin has a rectangular transverse slot 38 extending through the plates. The slot is generally dimensioned to be commensurate with the longitudinal sectional dimensions of the middle core leg 24. Furthermore, the widths of the plates 34, 36 are generally dimensioned to conform to the uniform distances between the leg 24 and legs 26 and 28. An insulator 31 is wrapped around the outer windings of the coil. The bobbin 32 is then mounted to the stack by forcing the middle leg 24 through the slot 38 so that the rear plate essentially engages the cross-piece 23 of the stack. The face plate 34 of the bobbin extends in a generally close fitting dual band-like relationship between the legs 24, 26 and 28. The face plate 34 is spaced rearwardly a small distance from the frontal edges of the legs. Electrical leads 39 extend from the coil for external electrical communication.

The housing 40, which in one embodiment may be of a unitary cast or molded form, has a contoured frontal panel 42 which defines a generally rectangular opening or frame 44. A pair of bosses 46 integrally protrude upwardly from the bottom panel 48 of the housing. Screws 50 thread from the bottom of the housing through the bosses 46 into threaded openings of the core stack for securing the core 20 to the housing 40. The edges 25, 27 and 29 of the core and the adjacent portions of the face plate 34 are framed by the opening 44. The opposing ends of the housing each have an integral cylindrical sleeve 52 including a counterbore for receiving bolts for mounting the housing to the underside of the door frame. A mounting plate (not illustrated) may be mounted to the top of the housing. The mounting plate includes an access port for the electrical leads 39 of the coil.

It should be appreciated that the foregoing electromagnetic lock 10 does not require potting of the coil 30. In the event that either a coil 30 or a core 20 is defective or malfunctions and requires replacement, the components may be relatively easily dismounted and replaced. The bobbin/core assembly may be produced in an efficient and cost-effective manner.

With reference to FIGS. 5 through 8, a second embodiment of an electromagnetic lock 11 is illustrated for an inswinging door installation. The lock is mounted to a door frame 16 by fasteners 56. An extension bracket 58 is mounted at the top of the door 14. The bracket 58 fixedly mounts an armature 12 of conventional form which is adapted and positioned for electrical bonding with the electromagnetic lock 11.

Figure 1:
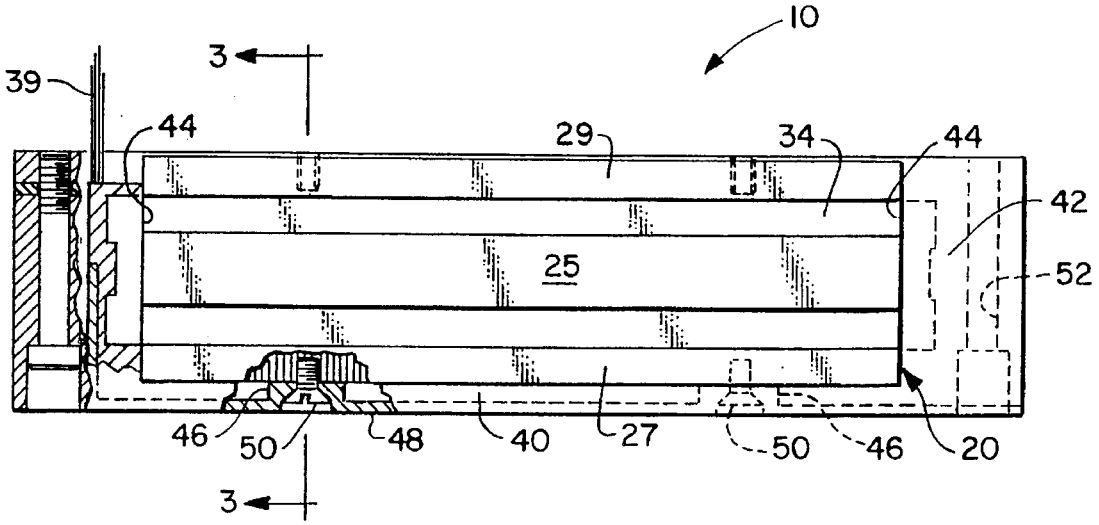
FIG. 1 is a frontal view, partly broken away, partly in section and partly in schematic, of an electromagnetic lock in accordance with the present invention.
Figure 2:
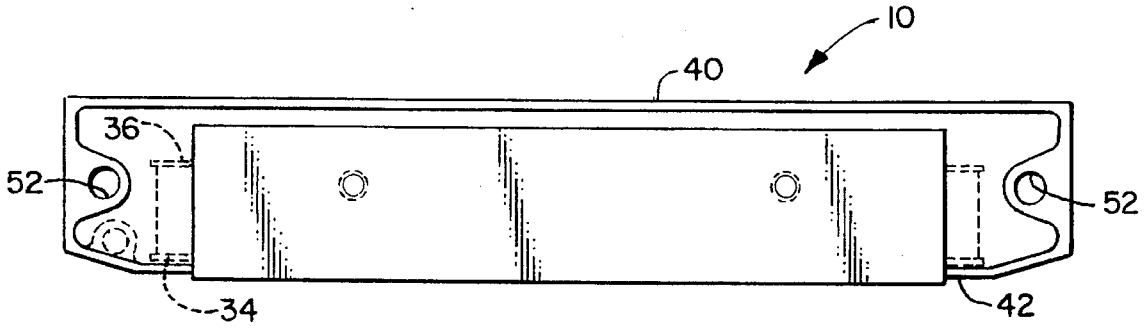
FIG. 2 is a top plan view, partly in schematic, of the electromagnetic lock of FIG. 1.
Figure 3:
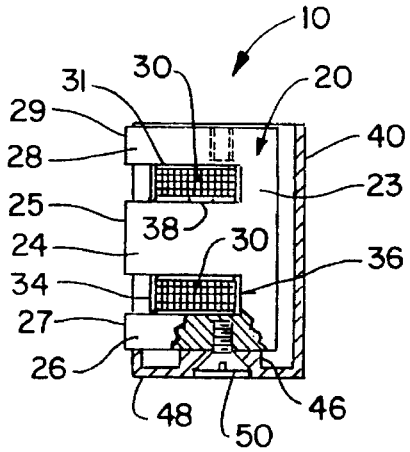
FIG. 3 is a sectional view, partly broken away, of the electromagnetic lock of FIG. 1 taken along the line 3—3 thereof.
Figure 4:
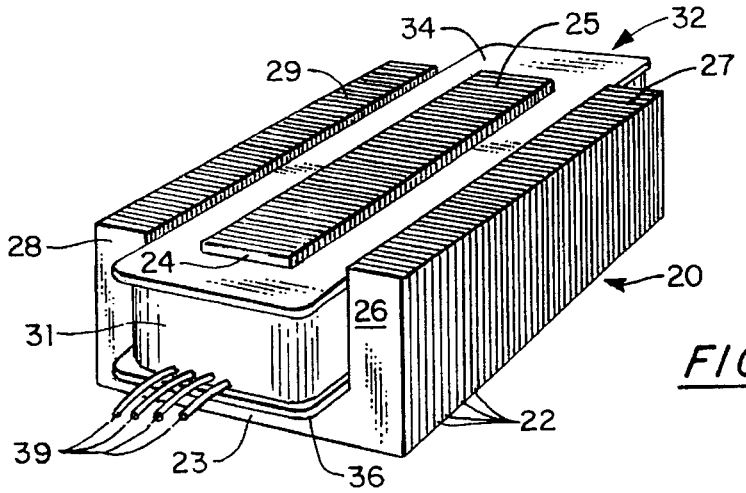
FIG. 4 is a perspective view of a portion of the electromagnetic lock of FIG. 1.
Figure 5:
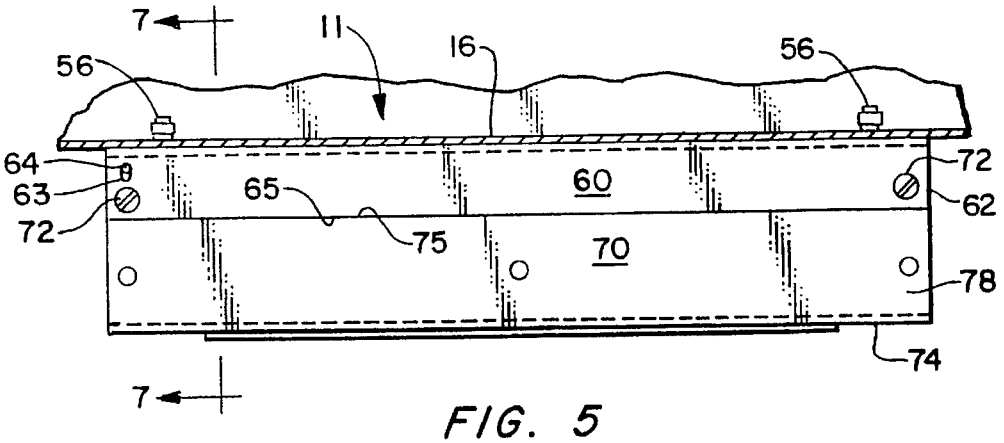
FIG. 5 is a top plan view, partly in schematic, of a second embodiment of an electromagnetic lock in accordance with the present invention, said lock being installed for an inswinging door installation and illustrated in a closed configuration in conjunction with a portion of a structure to which the lock is mounted.
Figure 6:
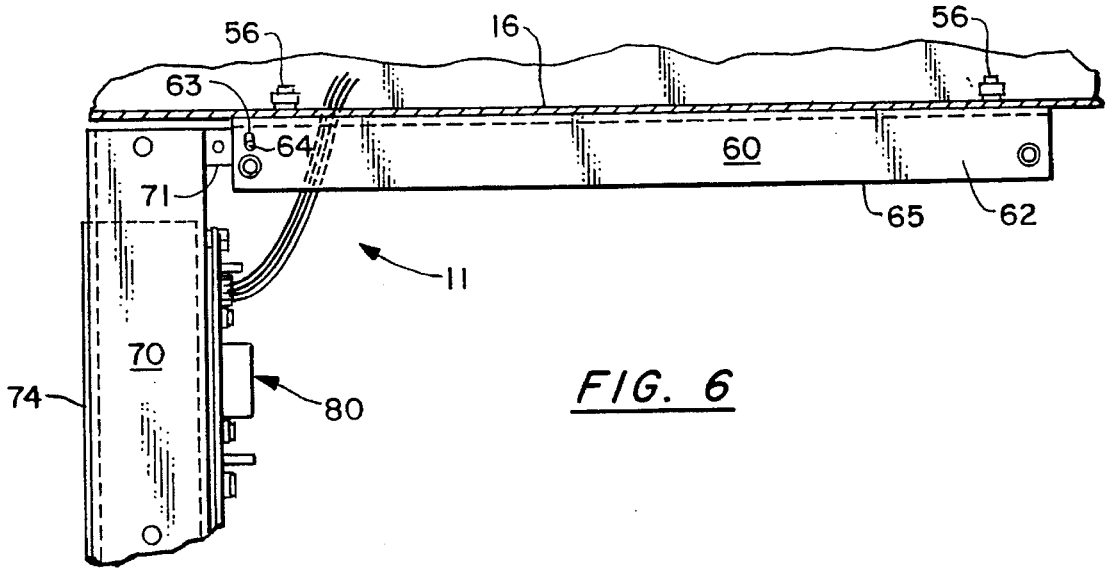
FIG. 6 is a fragmentary top plan view, partly in phantom, of the electromagnetic lock and the accompanying structure of FIG. 5, said lock illustrated in an open configuration.

The lock housing has cabinet-type configuration which is generally comprised of an elongated first section 60 and an elongated second section 70. Sections 60 and 70 are pivotally connected. The sections 60 and 70 cooperate to form a generally rectangular box-like housing in a closed position, as best illustrated in FIG. 5. The first section 60 includes a generally U-shaped channel member 62. For the inswinging door installation, the back of the member 62 is mounted against the door frame 16 by fasteners 56. One end of the member 62 has aligned slots 63 which each receive a pivot pin 64.

The second section 70 has a rectangular shape which includes substantial relatively sturdy end panels 71 and 73. Rear portions of the panels 71,73 are received by upper and lower flange-like portions of channel member 62. The pivot pins 64 project in opposite directions from panel 71. Longitudinally extending frontal edges 65 of member 62 engage complementary longitudinally extending rear edges 75 of section 70 in the closed position. The edges 65, 75 thus partially define a parting plane for the sections 60,70. When the first section 60 is mountably fixed, the second section 70 is thus pivotal between the closed aligned position FIG. 5 and the pivoted position of FIG. 6 to provide access to the interior of the housing, and in particular, core 20, the coil 30 and various circuitry as will be described below. The pins 64 slide along the slot as the second section is pivoted from the closed to the opened positions. Other pivotal or hinge connections are also possible. For example, a single pin may extend through a bore of panel 71. The closed position is secured by one or more fasteners 72 which thread from the top and bottom of member 62 into the end panels 71, 73.

The electromagnet, including the coil 30 and the core 20, is mounted in fixed position to the second section 70. A frontal panel 74 of the second section includes a rectangular window 76 for framing the exposed frontal edges of the core as well as the face plate 34 of the bobbin. In addition, a reinforcing plate 78 for reinforcing the second section housing may be mounted across the top. The plate 78 may be secured to section 70 by one or more screws or reinforcing pins 79. The reinforcing plate 78 enhances the structural rigidity of the second section 70 which mounts the relatively heavy electromagnet.

The compartment provided by the cooperating sections 60, 70 has ample space for mounting on board electronics and circuitry. The electronics and circuitry are prototypically generally designated by the numeral 80. Access to the circuitry 80 and the electromagnet may be relatively easily provided by pivotally withdrawing section 70 from section 60.

Figure 9:
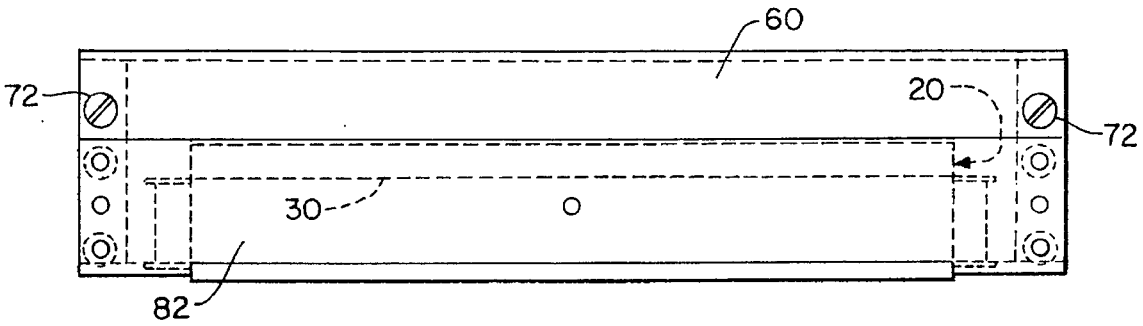
FIG. 9 is a top plan view, partly in schematic, illustrating an electromagnetic lock for an outswinging door installation.
Figure 10:
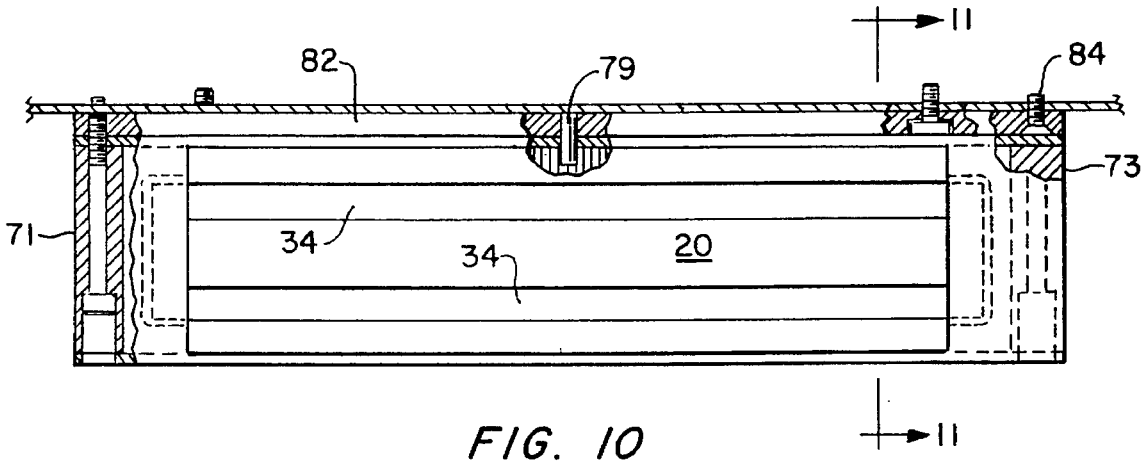
FIG. 10 is a frontal view, partly broken away, partly in section and partly in schematic, of the electromagnetic lock of FIG. 9.
Figure 11:
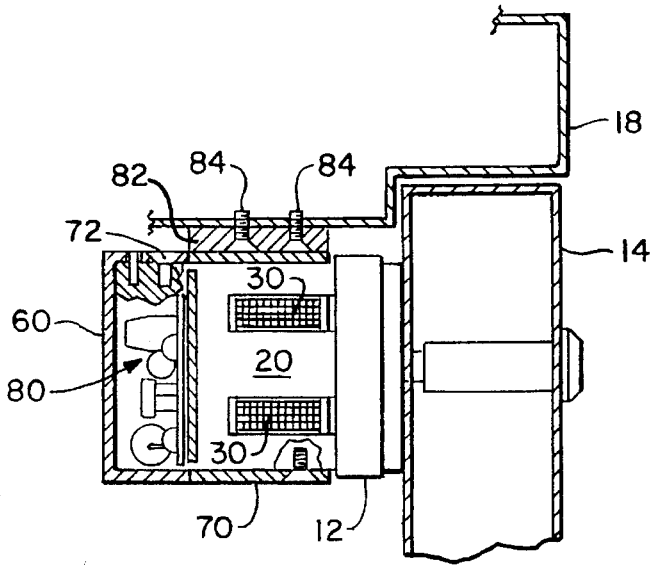
FIG. 11 is a side sectional view, partly broken away, of the lock of FIG. 10 in conjunction with the top of a door, said lock view being taken along the line 11—11 of FIG. 10.

The electromagnet lock 11 is also adapted for an outswinging door installation as illustrated in FIGS. 9 through 11. A mounting plate 82 is mounted by fasteners 84 to the underside of the door frame 18. Mounting plate 82 functions as a reinforcing plate for outswinging door applications. The outswinging door 14 includes an armature 12 which is mounted to the top portion of the door and is adapted and positioned for bonding with the electromagnetic lock 11. For the installation illustrated in FIGS. 9 through 11, after installation, the first section 60 is pivotal relative to the second section 70 which is essentially mounted in a fixed relationship with the frame 18. For the inswinging door application, section 60 need not be pivotal, and for some embodiments, section 60 may be dismounted by removing fasteners. Also, the back panel configuration of section 60 may be modified to eliminate mounting fastener openings for the outswinging door application.

Figure 12:
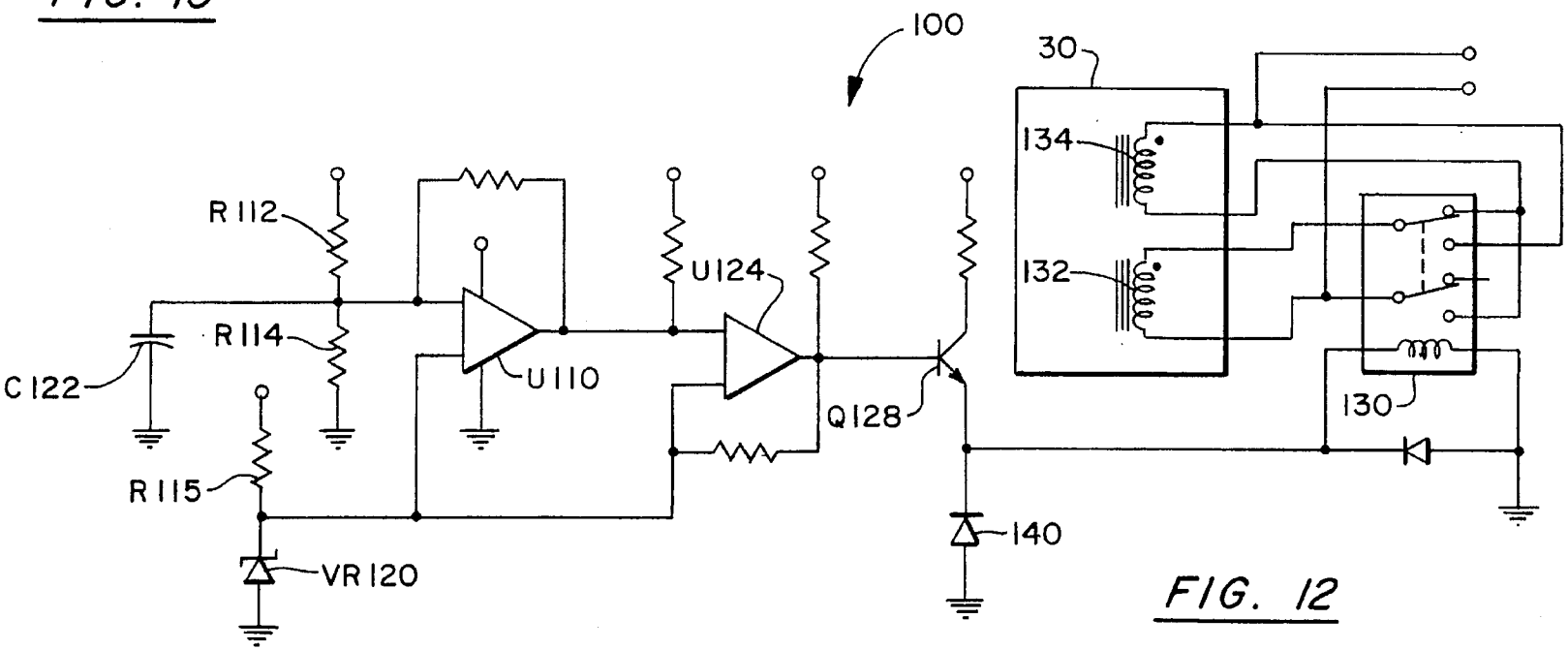
FIG. 12 is a schematic circuit diagram of a sensor circuit for the electromagnetic lock of FIG. 5.

With reference to FIG. 12, the electromagnetic locks 10 and 11 preferably incorporate a circuit designated generally by the numeral 100 for sensing the power supply voltage level and for automatically setting the operating voltage of the coil 30. The circuit 100 also automatically compensates for fluctuations in power supply voltage. In addition, if the operating system for the electromagnetic unit is changed after initial installation, it is not required to physically visit each of the electromagnetic lock units of a system and reset the operating voltage setting. The circuit 100 may be incorporated into the on board circuitry 80.

A comparator U110 detects the level of the supply voltage to the electromagnetic lock. Resistors R112 and R114 divide the supply voltage. The reference voltage is set by resistor R118 and a voltage reference VR120. A capacitor C122 filters the power supply noise and also prevents circuit switching during a slow power supply rise time. Comparator U110 is set for a 4 volt hysteresis band between 16 VDC and 20 VDC. The output from a second comparator U124 drives an output transistor Q128. The output transistor Q128 energizes a relay 130.

The relay 130 is configured to selectively connect two substantially identical coils 132, 134 in either series or parallel. Together coils 132, 134 comprise coil 30. In a preferred embodiment, the coils 132, 134 are connected in parallel when the supply voltage is less than 16 VDC. A Zener diode 140 regulates the relay coil voltage at 12 VDC when the transistor Q128 is activated. The relay 130 functions to connect the coils 132, 134 comprising coil 30 in parallel for a 12 VDC operation or in series for a 24 VDC operation. When the relay 130 is in a de-enerized state, the electromagnet is defaulted to a series connection for operation at 24 VDC.

Figure 13:
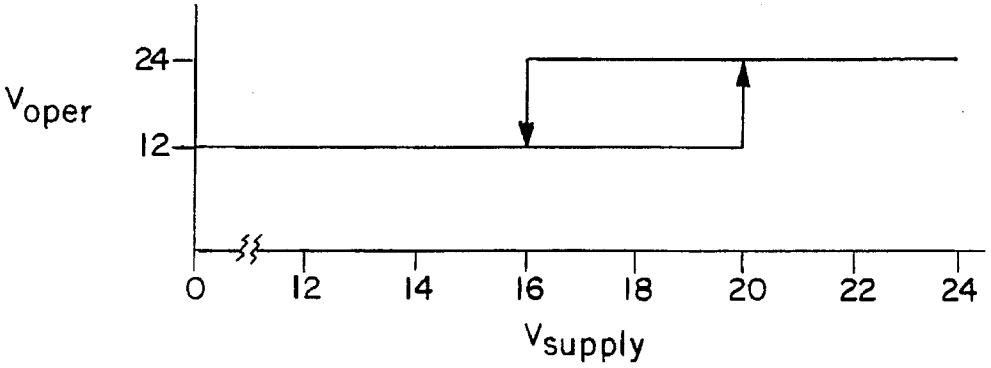
FIG. 13 is a graph representing the supply voltage and the operating voltage characteristics for one embodiment of the sensor circuit of FIG. 12.

With reference to FIG. 13, the horizontal axis represents the supply voltage to the electromagnet, and the vertical axis represents the operating voltage of the coil 30 of the electromagnet for one embodiment of sensor circuit 100. When power is applied to the electromagnet, the coils 132, 134 are connected in parallel by relay 130 to provide 12 VDC operation until the supply voltage reaches approximately 20 VDC. At approximately 20 VDC or greater the coils are connected in series by relay 130 to provide 24 VDC operation. As the supply voltage decreases from a value greater, than 16 VDC, the operational voltage remains at 24 VDC until the voltage decreases below approximately 16 VDC at which time the coils are connected to operate at 12 VDC.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An electromagnetic lock comprising:

core means for forming an elongated magnetic core comprising a stack of generally E-shaped laminations including first and second legs and a middle leg disposed between said first and second legs, each leg terminating in a substantially rectangular frontal end portion, said legs further terminating in generally coplanar frontal edges;

bobbin means for forming a bobbin having a face plate and slot means defining an elongated slot dimensioned to closely engage said middle leg so that said face plate extends in generally close abutting relationship between said first and middle leg end portions and between said second and middle leg end portions;

coil means for forming an electrical coil, said coil being wound around said bobbin means; and housing means for housing said core means, bobbin means and coil means, said housing means comprising opening means for defining an opening, at least a part of said frontal end portions of said first, second and third legs being disposed in said opening, said opening defining a frame surrounding at least a part of said frontal end portions and overlying a closely adjacent portion of said face plate.

2. The electromagnetic lock of claim 1 wherein each of said legs terminate in a frontal edge and said face plate is recessed from said frontal edges.

3. The electromagnetic lock of claim 1 wherein said bobbin means further comprises a rear plate generally parallel to said face plate and said coil means is disposed between said plates.

4. The electromagnetic lock of claim 1 wherein said face plate and edges are disposed in alternating adjacent relationship defining alternating parallel bands.

5. The electromagnetic lock of claim 1 wherein said face plate is composed of plastic material.

6. An electromagnetic lock comprising:

first section means for forming an elongated first enclosure section having a first end portion thereof;

second section means for forming an elongated second enclosure section, said second section having a second end portion and dimensioned to mate with said first section;

pivot means for pivotally connecting said first and second sections at said first and second end portions so that said sections are relatively movable between a closed position wherein said enclosure sections mate to form an enclosure having an interior thereof and a pivoted open position to provide access to said enclosure interior, said second section means having a frontal portion; and electromagnetic means for forming an electromagnet comprising core means and coil means disposed about said core means, said electromagnetic means mounted in fixed relationship to said second section, said coil means being energizable to produce a magnetic field traversing exteriorly from said frontal portion.

7. The electromagnetic lock of claim 6 wherein said sections each define a longitudinal axis and said pivot means defines a pivot axis which is generally orthogonal to said longitudinal axes.

8. The electromagnetic lock of claim 7 wherein said pivot means comprises a pivot pin.

9. The electromagnetic lock of claim 6 wherein said first section means comprises a generally U-shaped channel member and said second section means is partially received by said member in said closed position.

10. The electromagnetic lock of claim 6 further comprising lock means for securing said first and second section means in said closed position.

11. The electromagnetic lock of claim 10 wherein said lock means comprises at least one threaded fastener.

12. An electromagnetic lock comprising:

first section means for forming an elongated enclosure section comprising a generally U-shaped longitudinally extending member and having a first end portion thereof;

second section means for forming an elongated second enclosure section dimensioned to mate with said first section to form a box-like enclosure and having a second end portion thereof;

connector means for connecting said first and second sections at said first and second end portions so that said sections are relatively pivotally movable between a first closed position wherein said enclosure sections mate to form an enclosure having an interior thereof and a pivoted open position to provide access to said enclosure interior, said second section means having a frontal portion; and electromagnetic means for forming an electromagnet comprising core means and coil means disposed about said core means, said electromagnetic means mounted in fixed relationship to said second section, said coil means being energizable to produce a magnetic field traversing exteriorly from said frontal portion.

13. The electromagnetic lock of claim 12 wherein said sections engage along longitudinal parting edges and said connector means defines a pivot axis which is generally orthogonal to said edges.

14. The electromagnetic lock of claim 12 wherein said first section defines a slot and said connector means comprises a pin received in said slot.

15. The electromagnetic lock of claim 12 wherein said generally U-shaped member partially receives said second section means in said closed position.

16. The electromagnetic lock of claim 12 further comprising lock means for securing said first and second section means in said first position.

17. The electromagnetic lock of claim 16 wherein said lock means comprises at least one threaded fastener.

* * * * *